US008322297B2

(12) United States Patent
Petrenko

(10) Patent No.: US 8,322,297 B2
(45) Date of Patent: Dec. 4, 2012

(54) SECURING DEVICE

(76) Inventor: Leonid Petrenko, Sun City, AZ (US)

( * ) Notice: Subject to any disclaimer, the term of this patent is extended or adjusted under 35 U.S.C. 154(b) by 236 days.

(21) Appl. No.: 12/806,804

(22) Filed: Aug. 20, 2010

(65) Prior Publication Data

US 2010/0319605 A1 Dec. 23, 2010

Related U.S. Application Data

(63) Continuation-in-part of application No. 12/148,024, filed on Apr. 16, 2008, now abandoned.

(60) Provisional application No. 61/023,682, filed on Jan. 25, 2008.

(51) Int. Cl.
*G09F 17/00* (2006.01)

(52) U.S. Cl. ..... 116/173; 24/129 B

(58) Field of Classification Search ..... 116/173–175, 116/28 R, 209; 24/72.7, 711.1, 581.11, 369, 24/129 B, 129 R, 130, 909–910, 71.1, 115 H, 24/115 K; 428/99; 114/230.2, 218; D8/356, D8/395; 16/428; 52/511; 40/218, 607.11, 40/607.12; 403/325, 327, 330; 289/10, 14, 289/15; 182/5–6; 29/428
See application file for complete search history.

(56) References Cited

U.S. PATENT DOCUMENTS

| | | | | | |
|---|---|---|---|---|---|
| 115,826 | A * | 6/1871 | Creed | 114/115 |
| 468,819 | A * | 2/1892 | Mcanarney | 24/129 R |
| 749,235 | A * | 1/1904 | Smith | 24/129 R |
| 904,747 | A * | 11/1908 | Anderson | 24/130 |
| 1,069,776 | A * | 8/1913 | Foulis | 116/174 |
| D46,849 | S * | 1/1915 | Waltower | D8/395 |
| 1,338,210 | A * | 4/1920 | Buckley | 116/173 |
| 1,463,456 | A * | 7/1923 | Bear | 24/129 R |
| 2,884,674 | A * | 5/1959 | Neuberger | 24/129 R |
| 3,079,657 | A * | 3/1963 | Russell | 24/373 |
| 3,267,540 | A * | 8/1966 | Wolcott et al. | 24/130 |
| 4,319,537 | A * | 3/1982 | Hackney | 114/112 |
| 4,939,820 | A * | 7/1990 | Babcock | 24/129 R |
| 4,967,685 | A * | 11/1990 | Beck | 116/173 |
| 5,096,022 | A * | 3/1992 | Bowers | 188/65.1 |
| D355,583 | S * | 2/1995 | Beauchane | D8/356 |
| 5,511,291 | A * | 4/1996 | Crawford | 24/129 R |
| D458,533 | S * | 6/2002 | Sonju | D8/356 |
| 6,485,065 | B2 * | 11/2002 | Lusk et al. | 289/1.2 |
| 6,966,520 | B2 * | 11/2005 | Sherman et al. | 242/388.4 |
| D629,288 | S * | 12/2010 | Kelleghan | D8/356 |
| D642,448 | S * | 8/2011 | Lee et al. | D8/356 |
| 2006/0054070 | A1 * | 3/2006 | Lopes Praca | 114/218 |
| 2012/0048175 | A1 * | 3/2012 | Prince et al. | 116/173 |

* cited by examiner

*Primary Examiner* — Peter Macchiarolo
*Assistant Examiner* — Tania Courson
(74) *Attorney, Agent, or Firm* — Parsons & Goltry; Michael W. Goltry; Robert A. Parsons

(57) ABSTRACT

A flag securing assembly includes elongate member formed with an opening, opposed notched ends, and a lug projecting away from the elongate member and which terminates with a free end. A major loop of a line is applied through the opening and is folded over the elongate member forming in the line opposite minor loops applied to the opposed notched ends, a length of the line extending between the minor loops along the elongate member, and standing parts that project outward in opposite directions from the opposed notched ends. A grommet of a flag is applied to the lug between the free end of the lug and the elongate member, and a fastener is applied to the free end of the lug captively retaining the grommet of the flag between the free end of the lug and the elongate member.

16 Claims, 8 Drawing Sheets

SECURING DEVICE

CROSS-REFERENCE TO RELATED APPLICATION

This application is a continuation-in-part of U.S. patent application Ser. No. 12/148,024, filed Apr. 16, 2008, which, in turn, is related to and claims priority to U.S. Provisional Patent Application Ser. No. 61/023,682, filed Jan. 25, 2008.

FIELD OF THE INVENTION

The present invention relates to flags and, more particularly, to securing devices and connectors for attaching a flag to a line.

BACKGROUND OF THE INVENTION

Prior to the conception and development of the present invention, flags, as are generally well known in the prior art, have been secured to the cord of a flagpole via snap-on hooks. However, on occasion, such snap-on hooks have become disengaged resulting in the flag becoming tangled, ripped, damaged, etc. Furthermore, attaching a flag to such cord using a snap-on hook results in the flag being some distance away from the flagpole which is undesirable.

Referring to the prior art, Brewer, U.S. Pat. No. 6,857,386 provides a flag fastening assembly for fastening the upper and lower portion of the leading edge of a flag to a flag supporting member in a manner that balances the weight of the flag about the axis of the flag supporting member and prevents furling. Each flag fastening assembly includes the combination of a swivel that is positioned longitudinally on the flag supporting member by set screws, each swivel including an outwardly extending member with spaced apart holes near an outer edge thereof and a cord member attached through such holes and linked through a grommet near an adjacent inner corner of the flag.

Slick, U.S. Pat. No. 3,063,406, provides a means for displaying a flag, such means including flag anchors having a helix portion terminating in a flag engaging portion, such anchors being meant to secure such flag in a taut manner.

Baxter, U.S. Pat. No. 6,059,241 discloses a clip-type fastening device having a deformable and resilient body which is constructed of first and second deformable aperture defining portions which in combination define an aperture within the body. First and second engaging members are integrally formed with the deformable aperture defining portions and are inter-engageable to clamp the body around a fixed member in a step-lock fashion. The aperture defining portions and engaging members may be deformed and separated in a twisting manner to release the body from the fixed member and a deformable clip portion is likewise separable to releasably secure an object such as a length of cord or a flag grommet.

Blume, U.S. Pat. No. 4,852,733 provides a clip for mounting a flag on a staff, pole or like support. Such clip is formed of wire bent to define a circular coil from which a first leg and a second leg tangentially extend for connecting a flag to a flagpole without use of cords.

SUMMARY OF THE INVENTION

According to the principle of the invention, a flag securing assembly includes a generally flat, elongate member having opposed upper and lower faces, first and second inwardly notched ends, opposed parallel first and second sides extending between the opposed first and second inwardly notched ends, and a length extending from the first inwardly notched end to the second inwardly notched end. An opening is formed through the elongate member from the upper face to the lower face between the opposed first and second inwardly notched ends and the opposed parallel first and second sides. A lug is affixed to the elongate member, and the lug is positioned proximate to the first inwardly notched end and projects outward from the elongate member and terminates with a free end. A flag is formed with a grommet, and there is a line. A major loop is formed in the line forming opposed first and second standing parts in the line. The major loop is applied through the opening formed in the elongate member from the lower face of the elongate member to the upper face of the elongate member. The major loop is folded over the elongate member from the upper face to the lower face forming in the major loop opposite first and second minor loops on either end of the major loop at the first and second inwardly notched ends of the elongate member. The first and second minor loops are applied to the first and second inwardly notched ends, respectively, of the elongate member forming in the major loop a length of the line extending between the first and second minor loops along the lower face of the elongate member. The first and second standing parts formed in the line project outwardly and away from the opposed first and second inwardly notched ends in opposite directions and are pulled away from one another such that the first and second minor loops are tightened within the first and second inwardly notched ends, respectively, and the length of the line is tightened between the first and second minor loops applied to the first and second inwardly notched ends of the elongate member, and this secures the line to the elongate member. The grommet of the flag is applied to the lug between the free end of the lug and the elongate member, and a fastener is applied to the free end of the lug captively retaining the grommet of the flag between the free end of the lug and the elongate member securing the grommet of the flag to the elongate member. A hole is formed in the free end of the lug, and the fastener is applied to the hole captively retaining the grommet of the flag between the free end of the lug and the elongate member. A strand-securing hole is formed through the elongate member from the upper face to the lower face. The strand-securing hole is positioned proximate to the second inwardly notched end opposite to the lug formed proximate to the first inwardly notched end of the elongate member. The lug is integral with the elongate member. The opening formed through the elongate member extends along substantially the entire length of the elongate member from the first inwardly notched end to the second inwardly notched end.

According to the principle of the invention, a flag securing assembly includes a generally flat, elongate member having opposed upper and lower faces, opposed first and second inwardly notched ends, opposed parallel first and second sides extending between the opposed first and second inwardly notched ends, and a length extending from the first inwardly notched end to the second inwardly notched end. An opening is formed through the elongate member from the upper face to the lower face between the opposed first and second inwardly notched ends and the opposed parallel first and second sides. A lug is affixed to the first side of the elongate member. The lug is positioned proximate to the first inwardly notched end, and projects laterally outward from the first side of the elongate member and terminates with a free end. A flag is formed with a grommet, and there is a line. A major loop is formed in the line forming opposed first and second standing parts in the line. The major loop is applied through the opening formed in the elongate member from the lower face of the elongate member to the upper face of the elongate member. The major loop is folded over the elongate member from the upper face to the lower face forming in the major loop opposite first and second minor loops on either end of the major loop at the first and second inwardly notched ends of the elongate member. The first and second minor loops are applied to the first and second inwardly notched ends, respectively, of the elongate member forming in the major loop a length of the line extending between the first and second minor loops along the lower face of the elongate member. The first and second standing parts formed in the line project outwardly and away from the opposed first and second inwardly notched ends in opposite directions and are pulled away from one another such that the first and second minor loops are tightened within the first and second inwardly notched ends, respectively, and the length of the line is tightened between the first and second minor loops applied to the first and second inwardly notched ends of the elongate member, and this secures the line to the elongate member. The grommet of the flag is applied to the lug between the free end of the lug and the first side of the elongate member. A fastener is applied to the free end of the lug captively retaining the grommet of the flag between the free end of the lug and the first side of the elongate member securing the flag to the elongate member. A hole is formed in the free end of the lug, and the fastener is applied to the hole captively retaining the grommet of the flag between the free end of the lug and the first side of the elongate member. A strand-securing hole is formed through the elongate member from the upper face to the lower face. The strand-securing hole is positioned proximate to the second inwardly notched end opposite to the lug formed proximate to the first inwardly notched end of the elongate member. The strand-securing hole is located along the second side of the elongate member opposite to the first side of the elongate member. The lug is integral with the first side of the elongate member. The opening formed through the elongate member extends along substantially the entire length of the elongate member from the first inwardly notched end to the second inwardly notched end.

According to the principle of the invention, a flag securing assembly includes a generally flat, elongate member having opposed upper and lower faces, opposed first and second inwardly notched ends, opposed parallel first and second sides extending between the opposed first and second inwardly notched ends, and a length extending from the first inwardly notched end to the second inwardly notched end. First and second openings are formed through the elongate member from the upper face to the lower face between the opposed first and second inwardly notched ends and the opposed parallel first and second sides. A lug is affixed to the elongate member. The lug is positioned proximate to the first inwardly notched end and projects outward from the elongate member and terminates with a free end. A flag is formed with a grommet, and there is a line. The line is threaded through the first and second openings forming in the line a major loop along the upper face of the elongate member and opposed first and second standing parts along the lower surface of the elongate member at the opposed first and second notched ends of the elongate member. The major loop is folded over the elongate member from the upper face to the lower face forming in the major loop opposite first and second minor loops on either end of the major loop at the first and second inwardly notched ends of the elongate member. The first and second minor loops are applied to the first and second inwardly notched ends, respectively, of the elongate member forming in the major loop a length of the line extending between the first and second minor loops along the lower face of the elongate member. The first and second standing parts formed in the line project outwardly and away from the opposed first and second inwardly notched ends in opposite directions and are pulled away from one another such that the first and second minor loops are tightened within the first and second inwardly notched ends, respectively, and the length of the line is tightened between the first and second minor loops applied to the first and second inwardly notched ends of the elongate member, and this secures the line to the elongate member. The grommet of the flag is applied to the lug between the free end of the lug and the elongate member. A fastener is applied to the free end of the lug captively retaining the grommet of the flag between the free end of the lug and the elongate member securing the flag to the elongate member. A hole formed in the free end of the lug, and the fastener is applied to the hole captively retaining the grommet of the flag between the free end of the lug and the elongate member. A strand-securing hole is formed through the elongate member from the upper face to the lower face. The strand-securing hole is positioned proximate to the second inwardly notched end opposite to the lug formed proximate to the first inwardly notched end of the elongate member. The lug is integral with the elongate member. One of the first and second openings extends along substantially the entire length of the elongate member from the first inwardly notched end to the second inwardly notched end.

According to the principle of the invention, a flag securing assembly includes a generally flat, elongate member having opposed upper and lower faces, opposed first and second inwardly notched ends, opposed parallel first and second sides extending between the opposed first and second inwardly notched ends, and a length extending from the first inwardly notched end to the second inwardly notched end. Opposed first and second openings are formed through the elongate member from the upper face to the lower face between the opposed first and second inwardly notched ends and the opposed parallel first and second sides. A lug is affixed to the elongate member. The lug is positioned proximate to the first inwardly notched end, is positioned between the opposed first and second openings formed through the elongate member, and projects outward from the upper face of the elongate member terminates with a free end. A flag is formed with a grommet, and there is a line. The line, is threaded through the first and second openings forming in the line a major loop along the upper face of the elongate member and opposed first and second standing parts along the lower surface of the elongate member at the opposed first and second notched ends of the elongate member. The major loop is folded over the elongate member from the upper face to the lower face forming in the major loop opposite first and second minor loops on either end of the major loop at the first and second inwardly notched ends of the elongate member. The first and second minor loops are applied to the first and second inwardly notched ends, respectively, of the elongate member forming in the major loop a length of the line extending between the first and second minor loops along the lower face of the elongate member. The first and second standing parts formed in the line project outwardly and away from the opposed first and second inwardly notched ends in opposite directions and are pulled away from one another such that the first and second minor loops are tightened within the first and second inwardly notched ends, respectively, and the length of the line is tightened between the first and second minor loops applied to the first and second inwardly notched ends of the elongate member, and this secures the line to the elongate member. The grommet of the flag is applied to the lug between the free end of the lug and the upper face of the elongate member. A fastener is applied to the free end of the lug captively retaining the grommet of the flag between the free end of the lug and the upper face of the elongate member, and this secures the flag to the elongate member. A hole is formed in the free end of the lug, and the fastener is applied to the hole captively retaining the grommet of the flag between the free end of the lug and the upper face of the elongate member. A strand-securing hole is formed through the elongate member from the upper face to the lower face. The strand-securing hole is positioned proximate to the second inwardly notched end opposite to the lug formed proximate to the first inwardly notched end of the elongate member. The lug is integral with the elongate member. One of the first and second openings extends along substantially the entire length of the elongate member from the first inwardly notched end to the second inwardly notched end.

BRIEF DESCRIPTION OF THE DRAWINGS

Referring to the drawings.

DETAILED DESCRIPTION

Figure 1:
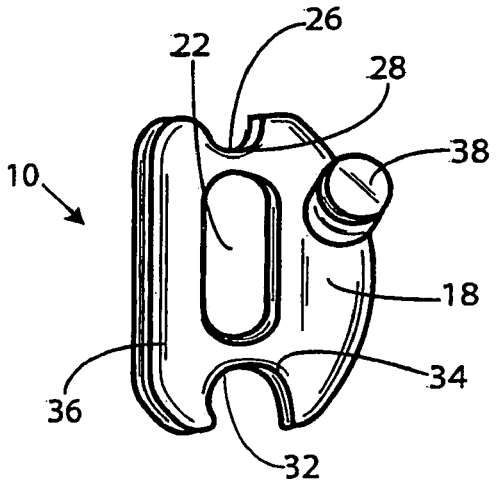
FIG. 1 is a perspective view of the invention according to one embodiment of the invention in which the securing device includes a support member having a first and a second recessed portion for use in securing a cord to the support member and such support member further includes a raised portion for insertion through a grommet of a flag.

Prior to proceeding to the more detailed description of the present invention it should be noted that, for the sake of clarity and understanding, identical components which have identical functions are identified with identical reference numerals throughout the several views illustrated in the drawing figures.

Reference is now made, more particularly, to FIGS. 1-13.

As illustrated in FIGS. 1, 3, 4, 5A and 5B, a securing device, generally designated 10, for securing a flag 12 (FIGS. 5A and 5B) having a grommet 14 (FIGS. 5A and 5B) to a cord 16 (FIGS. 3 and 4) is provided. Such securing device 10 includes a lug or support member 18 manufactured from a predetermined material and having a first predetermined shape and a first predetermined size.

It is presently preferred that such first predetermined material is at least one of a metal, a plastic, and a combination thereof. It is presently most preferred that such first predetermined material is a metal.

The support member 18 has at least one aperture 22 disposed therethrough at a predetermined location. Such aperture 22 has a second predetermined size and is capable of being threaded with such cord 16 for securing such cord 16 to the support member 18, such cord 16 having a third predetermined size.

A securing means 24 is operably connectable to the support member for securing such flag 12 to the support member 18.

It is presently preferred that such securing means 24 is at least one of a pin type fastener, screw type fastener, round head type fastener, twist tie type fastener, bendable prong type fastener, cuff link type fastener, bolt type fastener, threaded member type fastener, a snap type fastener, and a combination nut and bolt type fastener.

According to a first embodiment of the invention, the support member 18 has at least one aperture 22 disposed therethrough at a predetermined location and has a first recessed portion 26 at a first predetermined end 28 thereof and a second recessed portion 32 at a second predetermined end 34 thereof for use in attaching such cord 16 to the support member 18.

It is presently preferred that such support member 18 includes a substantially flat portion 36, through which the at least one aperture 22 is disposed, and a substantially raised portion 38 for receiving such grommet 14 of such flag 12, each of the portions having a predetermined shape and a predetermined size.

According to the presently preferred embodiment, the substantially raised portion 38 includes at least one aperture 21 extending therethrough at a predetermined location thereon for receiving such securing means 24 after the raised portion 38 has been inserted through such grommet 14. It is presently preferred that such securing means 24 is at least one of a pin type fastener, a screw type fastener, a round head type fastener, a twist tie type fastener, a bendable prong type fastener, a cuff link type fastener, bolt type fastener, threaded member type fastener, a snap type fastener, and a combination nut and bolt type fastener.

Figure 5B:
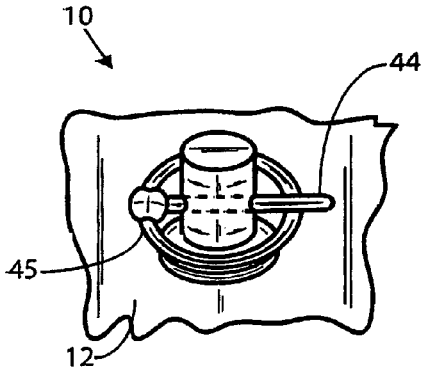
FIG. 5B is a perspective view of the invention according to one embodiment of the invention in which a raised portion of such support member has been inserted through the grommet of a flag and a pin type securing member having a hinged member is being implemented; the pin type member has been inserted into the aperture on the substantially raised portion and the hinged member is in the closed position thereby securing the flag to the support member.
Figure 5A:
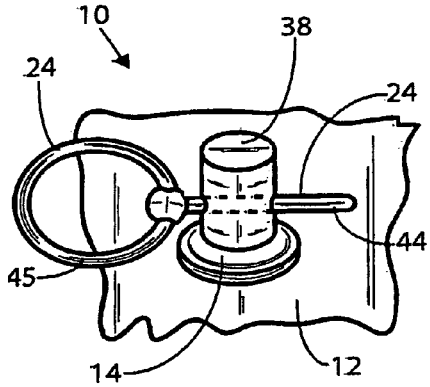
FIG. 5A is a perspective view of the invention according to one embodiment of the invention in which a raised portion of such support member has been inserted through the grommet of a flag and a pin type securing member having a hinged member is being implemented, the pin type member has been inserted into the aperture on the substantially raised portion.

As illustrated in FIGS. 5A and 5B, It is presently most preferred that such securing means 24 is a pin member 44 having a first predetermined size, a first predetermined shape and a predetermined length, such pin member 44 being for inserting into such at least one aperture 21 on such raised portion 38 after a flag grommet 14 has been placed over such raised portion 38, such pin member 44 further including a hinged member 45 operably connected thereto at a predetermined end thereof, the hinged member 45 being moveable between an open position for allowing the pin member 44 to be inserted into such at least one aperture 21 and a closed position for securing such pin member 44 to such raised portion 38 such that the flag 12 is secured to the securing device 10.

Figure 2:
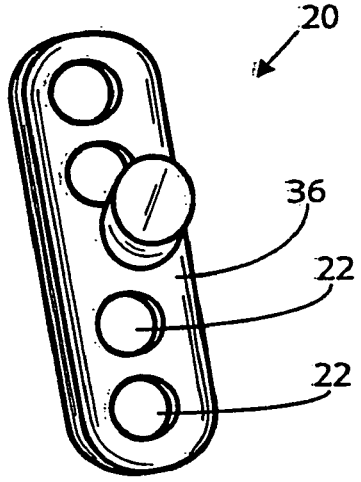
FIG. 2 is a perspective view of the invention according to one embodiment of the securing device in which the support member includes four apertures capable of being threaded with a cord.
Figure 3:
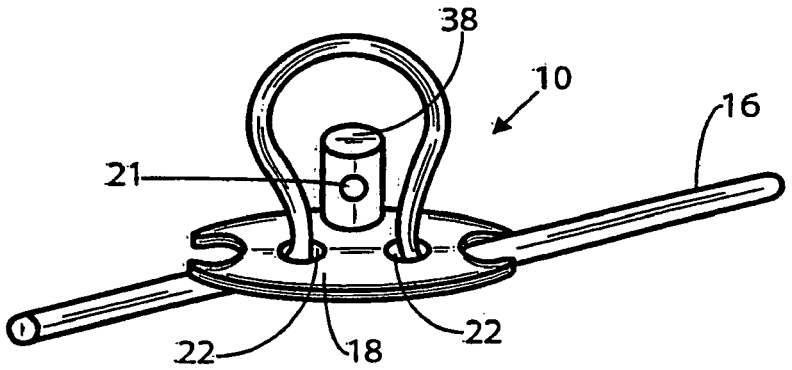
FIG. 3 is a perspective view of the invention according to one embodiment of the securing device in which a portion of a cord is being inserted into an aperture disposed through the support member.
Figure 4:
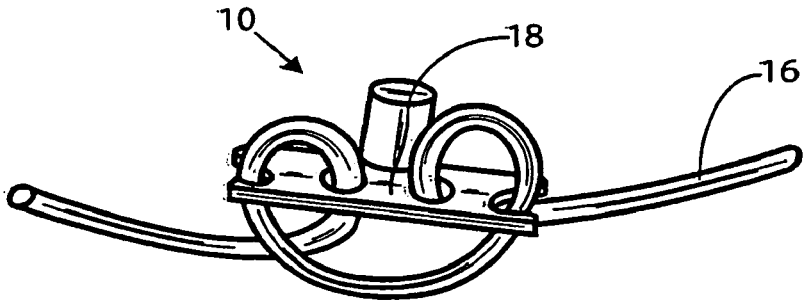
FIG. 4 is a perspective view of the invention according to one embodiment of the invention in which a portion of a cord has being inserted into an aperture disposed through such support member and such cord is being secured around recessed portions of such securing device.

Referring to FIG. 2, according to a second embodiment, the securing device, generally designated 20, has a substantially flat portion 36 which includes at least four apertures 22 capable of being threaded with such cord 16 for securing such cord 16 to the support member 18.

Figure 6:
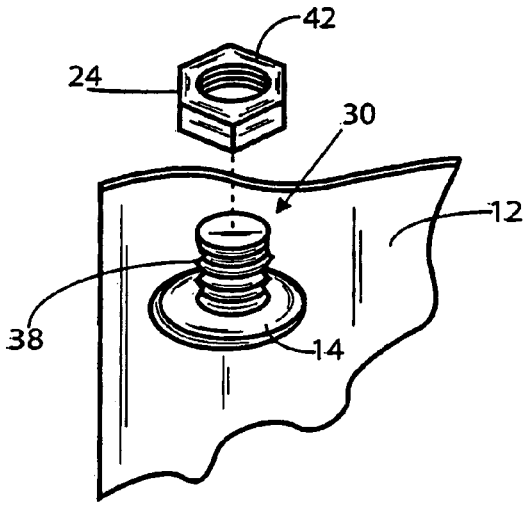
FIG. 6 is a perspective view of the invention according to one embodiment of the invention in which a raised portion of such support member has been inserted through the grommet of a flag, such raised portion being threaded for receiving a nut, thereby enabling a user to secure such nut to the threaded raised portion and secure such flag in place.

Referring to FIG. 6, according to a third embodiment of the invention, the securing device, generally designated 30, has a raised portion 38 threaded for receiving a nut 42. According to this particular embodiment, it is presently preferred that such securing means 24 is such nut 42, such nut being capable of being screwed onto the raised portion 38 after the raised portion 38 has been inserted into such grommet 14 thereby securing such flag 12 to the support member 18.

Figure 7:
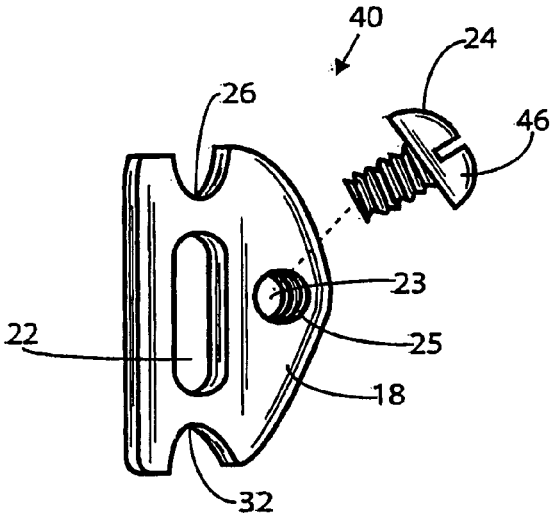
FIG. 7 is a perspective view of the invention according to one embodiment of the invention in which an aperture disposed through the support member is threaded for receiving a threaded member.

Referring to FIG. 7, according to a fourth embodiment of the invention, the securing device, generally designated 40, includes at least one aperture 22 disposed therethrough such support member 18 an equal distance between the first 26 and the second 32 recessed portions and at least a second aperture 23 disposed through such support member 18, the second aperture 23 being for alignment with such grommet 14 and for receiving such securing means 24.

Figure 8:
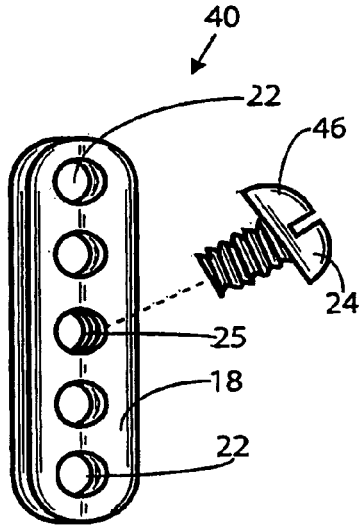
FIG. 8 is a perspective view of the invention according to one embodiment of the securing device in which the support member includes four apertures for securing a cord and a fifth threaded aperture for alignment with the grommet of a flag and thereafter for receiving a threaded member for securing such flag to such support member and such cord.

Again referring to FIG. 7 and also to FIG. 8, according to still another embodiment, such support member 18 includes a plurality of apertures 22 disposed therethrough at predetermined locations and a predetermined aperture 25 is threaded for receiving and securing a threaded member 46 therein. In this particular embodiment the securing means 24 is a threaded member 46, such threaded member 46 being screwed into such threaded aperture 25 after such grommet 14 has been aligned with such threaded aperture 25.

Figure 9:
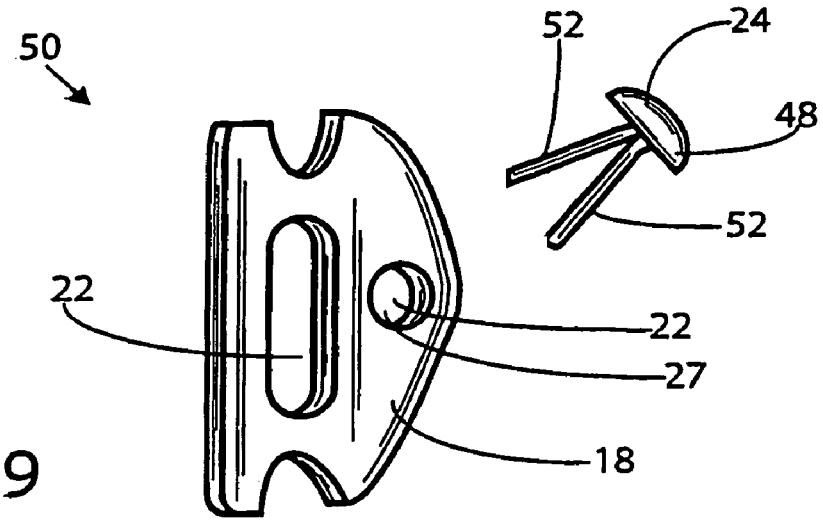
FIG. 9 is a perspective view of the invention according to one embodiment of the invention in which the support member includes an aperture disposed therethrough for receiving a round head type fastener.
Figure 10:
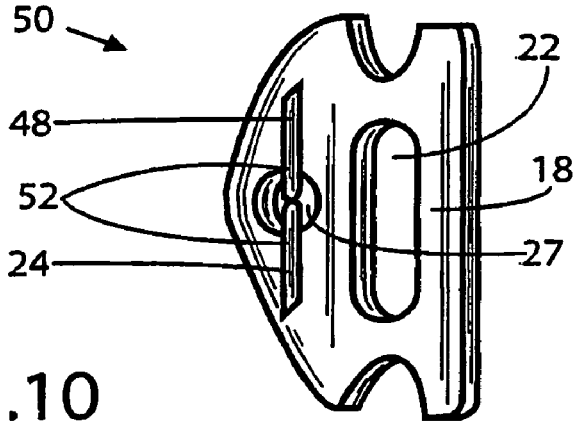
FIG. 10 is a perspective rear view of the invention according to one embodiment of the invention in which a round head type fastener has been inserted through a flag grommet aligned with an aperture disposed through such support member and in which the bendable prongs of the round head type fastener have been bent in opposite directions thereby securing such flag to the support member.

As illustrated in FIG. 9 and FIG. 10, in still another embodiment of the invention, the securing device, generally designated 50, includes such support member 18 having a plurality of apertures 22 and such securing means 24 being a round head type fastener 48 having at least two bendable shanks 52 attached thereto for insertion through such grommet 14 and through a predetermined aperture 27 and thereafter such shanks 52 being capable of being bent in opposite directions for securing such flag 12 to the support member 18.

Figure 11:
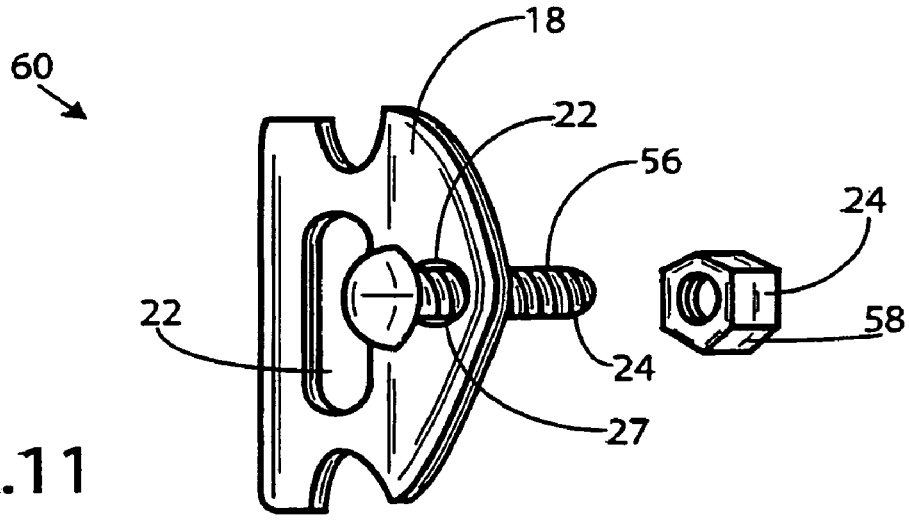
FIG. 11 is a perspective view of the invention according to one embodiment of the securing device in which a nut and bolt combination may be used to secure a flag to such support member.

In an additional embodiment of the invention, as illustrated in FIG. 11, the securing device, generally designated 60, includes such support member 18 having a plurality of apertures 22 disposed therethrough and the securing means 24 includes a nut and bolt combination, the bolt 56 being capable of being inserted through both of a predetermined aperture 27 and such grommet 14, such grommet 14 being aligned with the predetermined aperture 27, and thereafter the bolt 56 being capable of being screwed into the nut 58.

Figure 13:
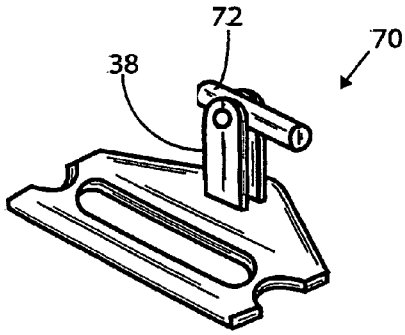
FIG. 13 is a perspective view of the invention according to one embodiment of the invention in which a hinged member is operably connected to the substantially raised portion.
Figure 12:
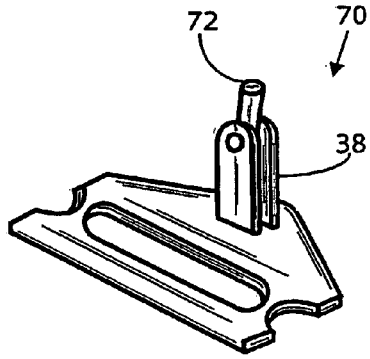
FIG. 12 is a perspective view of the invention according to one embodiment of the invention in which a hinged member is operably connected to the substantially raised portion.

In yet another embodiment of the invention, as illustrated in FIG. 12 and FIG. 13, the securing device, generally designated 70 includes a substantially raised portion 38 having a hinged member 72 disposed adjacent an upper end thereof. Such hinged member 72 has a predetermined size and a predetermined shape. Such hinged member 72 is moveable between a first position, as depicted in FIG. 12, wherein the hinged member 72 is substantially parallel to the substantially raised portion 38 for allowing the substantially raised portion 38 to be inserted through such flag grommet 14 and a second position, as depicted in FIG. 13, wherein the hinged member 72 is substantially perpendicular to the substantially raised portion 38 for securing such flag 12 to the device 70. It is presently preferred that the hinged member 72 automatically at least one of returns to and occupies such second position when not being manipulated by a user.

Figure 14:
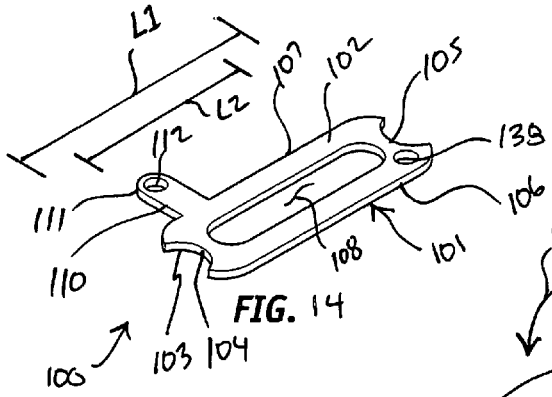
FIG. 14 is a perspective view of a yet another embodiment of securing device for securing a line to a flag grommet.
Figure 15:
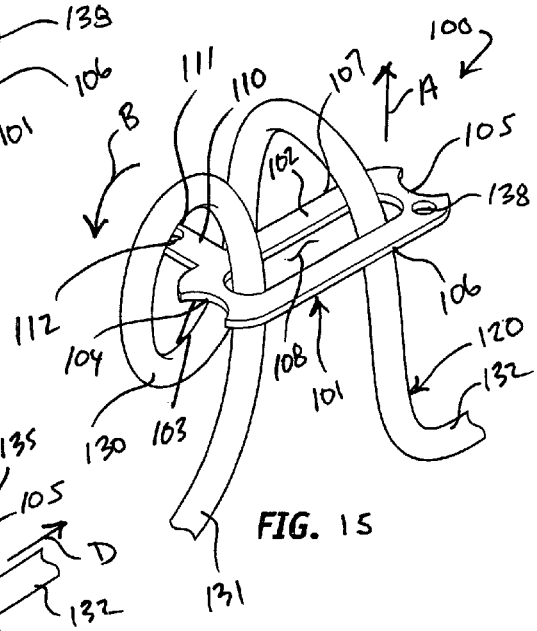
FIGS. 15-17 are perspective views of a sequence of steps of coupling the securing device of FIG. 14 to a line and to a flag grommet.
Figure 16:
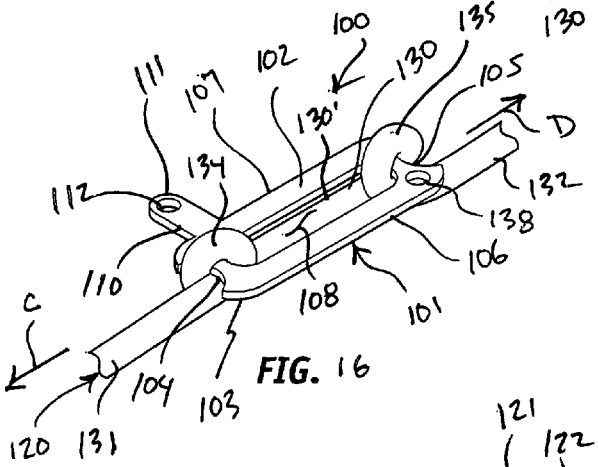
Figure 17:
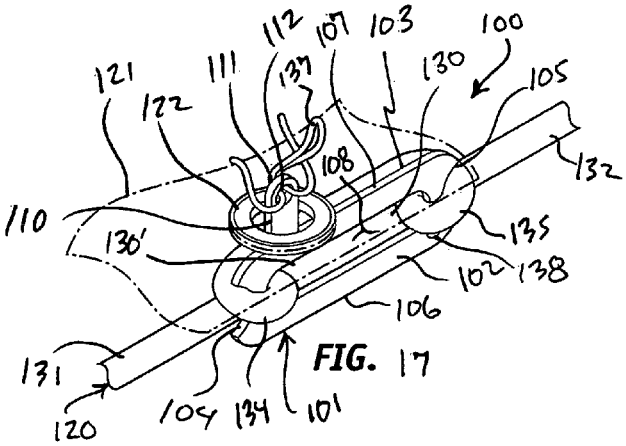

Reference is now made to FIG. 14, which is a perspective view of a yet another embodiment of a securing device 100 for securing a cord or line to a flag grommet, and to FIGS. 15-17, which are perspective views of a sequence of steps of coupling securing device 100 of FIG. 14 to a cord or line and to a flag grommet forming a flag securing assembly as shown in FIG. 17. Referencing FIG. 14, securing device 100 is fashioned of steel, aluminum, or the like, is preferably integrally formed, such as by stamping, machining, or molding, and consists of a generally flat, elongate member 101 having opposed upper and lower faces 102 and 103, opposed inwardly notched ends 104 and 105, opposed parallel sides 106 and 107 extending between opposed inwardly notched ends 104 and 105, and a length L1 extending from inwardly notched end 104 to inwardly notched end 105. An opening 108 is formed through elongate member 101 from upper face 102 to lower face 103 opposed inwardly notched ends 104 and 105 and opposed sides 106 and 107. Opening 108 is elongate and has a length L2 that extends along substantially the entire length L1 of elongate member 111 from notched end 104 to notched end 105. A lug 110 is affixed to elongate member 101. Lug 110 is positioned proximate to inwardly notched end 104, is integral with side 106 and projects laterally outward from side 106 of elongate member 101 and terminates with a free end 111 formed with a hole 112.

A line 120 is depicted in conjunction with securing device 100 in FIGS. 15-17, and in FIG. 17 there is illustrated a flag 121 formed with a grommet 122. Flag 121 is depicted in phantom outline for illustrative purposes to clearly illustrate the attachment and interrelationship between grommet 122 formed in flag 121 and securing device 100. Securing device 100 is coupled between line 120 and grommet 122 of flag 121 to secure line 120 to flag 121.

To couple line 120 to securing device 100, a major loop 130 is formed in line 120 forming opposed standing parts 131 and 132 in the line 120. Referencing FIG. 15, major loop 130 is applied through opening 108 formed in elongate member 101 from lower face 103 of elongate member 101 to upper face 102 of elongate member 101 in the direction indicated by arrowed line A locating major loop 130 along upper face 102 of elongate member 101 and locating standing parts 131 and 132 along lower face 103 of elongate member 101. Major loop 130 is then folded over the elongate member 101 from upper face 102 to lower face 103 in the direction indicated by arcuate arrowed line B forming in major loop 130 opposite minor loops 134 and 135 at either end of the major loop 130 at inwardly notched ends 104 and 105 of elongate member 101 as shown in FIG. 16, which are applied to or otherwise looped about inwardly notched ends 104 and 105 of elongate member 101 forming in major loop 130 a length 130' of line 120 extending between minor loops 134 and 135 along lower face 103 of elongate member 101. Standing parts 131 and 132 formed in line 120 are drawn outwardly to project outwardly and away from inwardly notched ends 104 and 105, respectively, in opposite directions and are pulled away from one another in the directions indicated by arrowed lines C and D, respectively, such that minor loops 134 and 135 are tightened about and within inwardly notched ends 104 and 104, respectively, as shown in FIGS. 16 and 17, and length 130' of line 120 is tightened between minor loops 134 and 135 applied to inwardly notched ends 104 and 105, respectively, of elongate member 101, and this secures the line 120 to elongate member 101.

To attach flag 121 to securing device 100 coupled to line 120 as described and shown in FIGS. 16 and 17, grommet 122 of the flag 121 is applied to lug 110 as shown in FIG. 17 between free end 111 of lug 110 and side 107 of elongate member 101, and a fastener 137 is then applied to free end 111 of lug 110 captively retaining grommet 122 of flag 121 between free end 111 of lug 110 and elongate member 101 securing grommet 122 of flag 121 to elongate member 101 thereby securing flag 121 to securing device 100 forming a flag securing assembly constructed and arranged in accordance with the principle of the invention. To apply fastener 137 to free end 111 of lug 110, fastener 137 is applied to hole 112 captively retaining grommet 122 of flag 121 between fastener 137 coupled to free end 111 of lug 110 and elongate member 101 of securing device 100. In the present example, fastener 137 is a bendable, deformable wire. In alternate embodiment, fastener 137 can take on other forms, such as the form of a nut-and-bolt assembly, the form of a pin, etc.

As seen in FIGS. 14-17, a strand-securing hole 138 is formed through elongate member 101 from upper face 102 to lower face 103. Strand-securing hole 138 is positioned proximate to or otherwise at inwardly notched end 105 opposite to lug 110 formed proximate to or otherwise at inwardly notched end 104 of elongate member 101. Furthermore, although lug 110 is formed at side 107 of elongate member 101 and projects laterally outward from side 107, strand-securing hole 138 is formed at side 106 opposite to side 107 and lug 110 formed at side 107. Strand-securing hole 138 is used to receive lashing for lashing securing device 110 to a support, such as a flag pole or other support. As strand-securing hole 138 is formed at side 106, side 106 may be directed at the support and lashed thereto with the use of strand-securing hole 138 to securely hold flag 121 on the opposite side of elongate member 101 of securing device 100, namely, side 107, in accordance with the principle of the invention.

Figure 18:
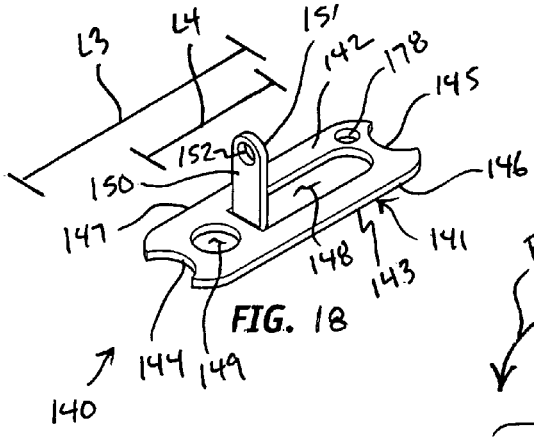
FIG. 18 is a perspective view of a further embodiment of securing device for securing a line to a flag grommet.
Figure 19:
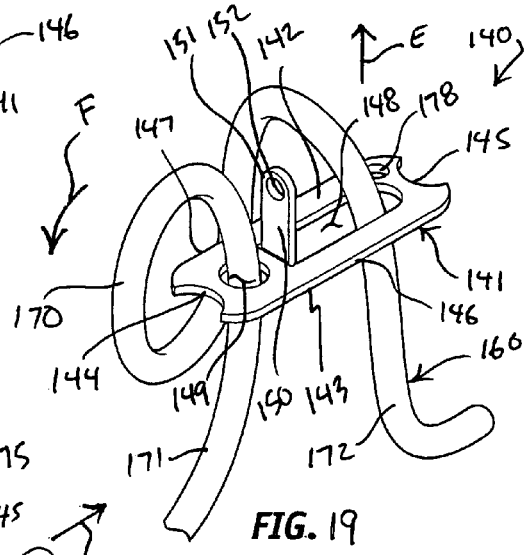
FIGS. 19-21 are perspective views of a sequence of steps of coupling the securing device of FIG. 18 to a line and to a flag grommet.
Figure 20:
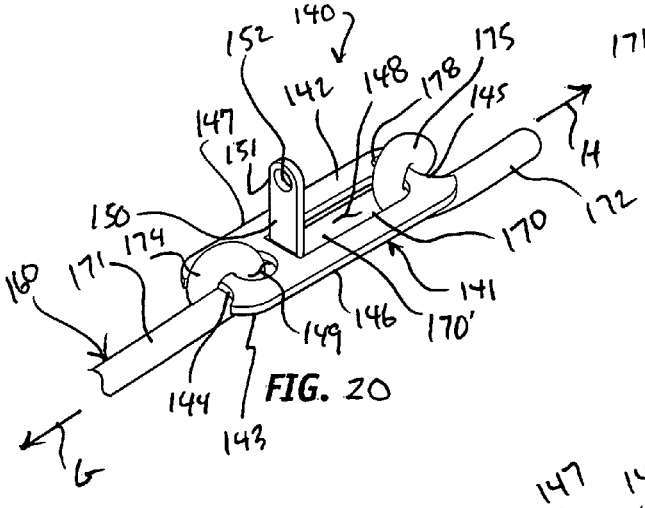
Figure 21:
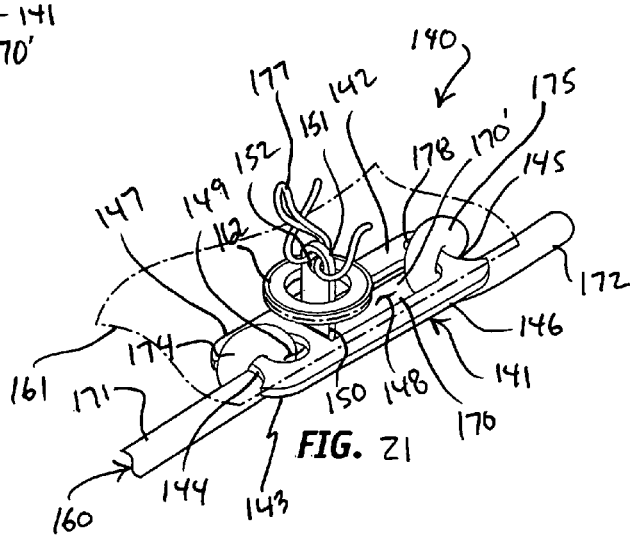

Reference is now made to FIG. 18, which is a perspective view of still a further embodiment of a securing device 140 for securing a cord or line to a flag grommet, and to FIGS. 19-21, which are perspective views of a sequence of steps of coupling securing device 140 of FIG. 18 to a cord or line and to a flag grommet forming a flag securing assembly as shown in FIG. 21. Referencing FIG. 18, securing device 140 is fashioned of steel, aluminum, or the like, is preferably integrally formed, such as by stamping, machining, or molding, and consists of a generally flat, elongate member 141 having opposed upper and lower faces 142 and 143, opposed inwardly notched ends 144 and 145, opposed parallel sides 146 and 147 extending between opposed inwardly notched ends 144 and 145, and a length L3 extending from inwardly notched end 144 to inwardly notched end 145. Openings 148 and 149 are formed through elongate member 141 from upper face 142 to lower face 143 between opposed inwardly notched ends 144 and 145 and opposed sides 146 and 147. Opening 148 is positioned toward inwardly notched end 145, and opening 149 is positioned toward inwardly notched end 144. Opening 148 is considerably larger than opening 148, and has a length L4 that extends along substantially the entire length L2 of elongate member 151 from notched end 144 to notched end 145. In other words, length L4 of opening 148 is more than half as long as length L3 of elongate member, and as such Length L4 extends along substantially the entire length L3 of elongate member 141. A lug 150 is affixed to elongate member 141. Lug 150 is positioned proximate to inwardly notched end 144, is located between openings 148 and 149, is integral with upper face 142, and projects outward from upper face 142 of elongate member 141 and terminates with a free end 151 formed with a hole 152.

A line 160 is depicted in conjunction with securing device 140 in FIGS. 19-21, and in FIG. 21 there is illustrated a flag 161 formed with a grommet 162. Flag 161 is depicted in phantom outline for illustrative purposes to clearly illustrate the attachment and interrelationship between grommet 162 formed in flag 161 and securing device 140. Securing device 140 is coupled between line 160 and grommet 162 of flag 161 to secure line 160 to flag 161.

To couple line 160 to securing device 140, line 160 is threaded through openings 148 and 149 forming in line 160 a major loop 170 along upper face 142 of elongate member 141 and forming opposed standing parts 171 and 172 in the line 160 along lower face 143 of elongate body 141. Referencing FIG. 19, major loop 170 is applied through opening 148 formed in elongate member 141 from lower face 143 of elongate member 141 to upper face 142 of elongate member 141 in the direction indicated by arrowed line E. Major loop 170 is then folded over the elongate member 141 from upper face 142 to lower face 143 in the direction indicated by arcuate arrowed line F forming in major loop 170 opposite minor loops 174 and 175 at either end of the major loop 170 at inwardly notched ends 144 and 145 of elongate member 141 as shown in FIG. 20, which are applied to or otherwise looped about inwardly notched ends 144 and 145 of elongate member 141 forming in major loop 170 a length 170' of line 160 extending between minor loops 174 and 175 along lower face 143 of elongate member 141. Standing parts 171 and 172 formed in line 160 are drawn outwardly to project outwardly and away from inwardly notched ends 144 and 145, respectively, in opposite directions and are pulled away from one another in the directions indicated by arrowed lines G and H, respectively, such that minor loops 174 and 175 are tightened about and within inwardly notched ends 144 and 144, respectively, as shown in FIGS. 20 and 21, and length 170' of line 160 is tightened between minor loops 174 and 175 applied to inwardly notched ends 144 and 145, respectively, of elongate member 141, and this secures the line 160 to elongate member 141.

To attach flag 161 to securing device 140 coupled to line 160 as described and shown in FIGS. 20 and 21, grommet 162 of the flag 161 is applied to lug 150 as shown in FIG. 21 between free end 151 of lug 150 and upper face 142 of elongate member 141, and a fastener 177 is then applied to free end 151 of lug 150 captively retaining grommet 162 of flag 161 between free end 151 of lug 150 and upper face 142 of elongate member 141 securing grommet 162 of flag 161 to elongate member 141 thereby securing flag 161 to securing device 140 forming a flag securing assembly constructed and arranged in accordance with the principle of the invention. To apply fastener 177 to free end 151 of lug 150, fastener 177 is applied to hole 152 captively retaining grommet 162 of flag 161 between fastener 177 coupled to free end 151 of lug 150 and elongate member 141 of securing device 140. In the present example, fastener 177 is a bendable, deformable wire. In alternate embodiment, fastener 177 can take on other forms, such as the form of a nut-and-bolt assembly, the form of a pin, etc.

As seen in FIGS. 18-21, a strand-securing hole 178 is formed through elongate member 141 from upper face 142 to lower face 143. Strand-securing hole 178 is positioned along side 147 of elongate body 141 proximate to or otherwise at inwardly notched end 145 opposite to lug 150 formed proximate to or otherwise at inwardly notched end 144 of elongate member 141. Strand-securing hole 178 is used to receive lashing for lashing securing device 150 to a support, such as a flag pole or other support.

Figure 22:
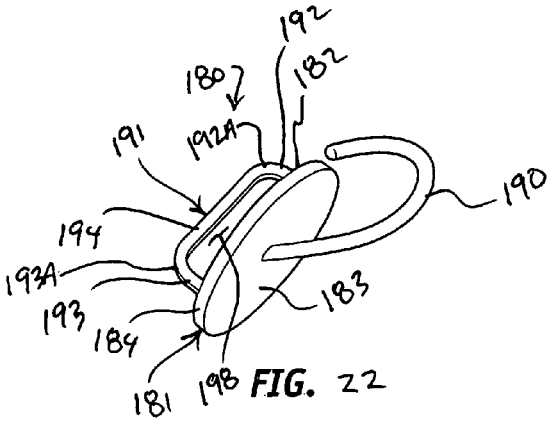
FIG. 22 is a perspective view of a yet a further embodiment of securing device for securing a line to a flag grommet.
Figure 23:
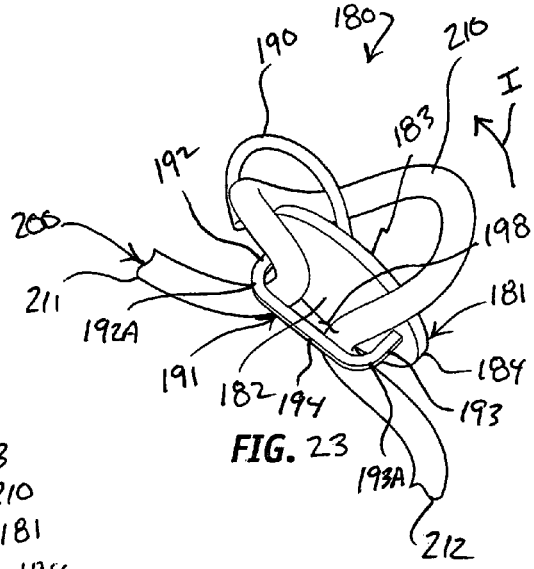
FIGS. 23-25 are perspective views of a sequence of steps of coupling the securing device of FIG. 20 to a line and to a flag grommet.
Figure 24:
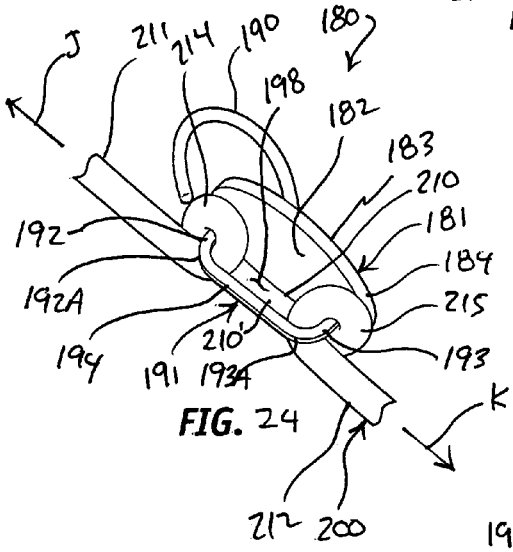
Figure 25:
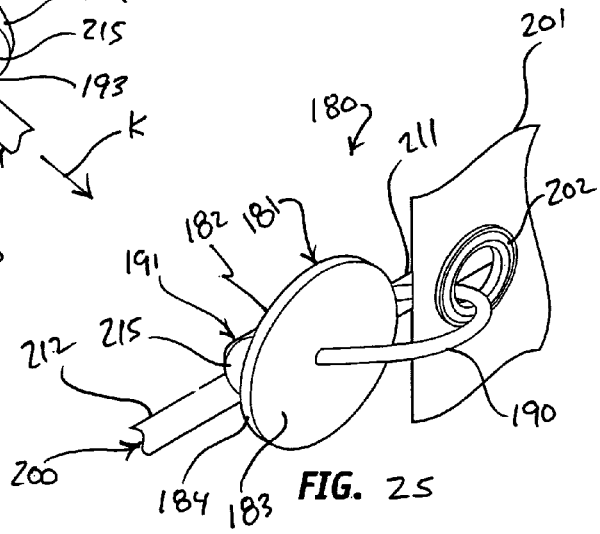

Reference is now made to FIG. 22, which is a perspective view of a yet still a further embodiment of a securing device 180 for securing a cord or line to a flag grommet, and to FIGS. 23-25, which are perspective views of a sequence of steps of coupling securing device 180 of FIG. 22 to a cord or line and to a flag grommet forming a flag securing assembly as shown in FIG. 25. Referencing FIG. 22, securing device 180 is fashioned of steel, aluminum, or the like, is preferably integrally formed, such as by stamping, machining, or molding, and consists of a generally flat and generally circular slug or member 181 having opposed upper and lower faces 182 and 183, and a perimeter edge 184. Upper face 182 is formed with an eyelet or eyelet connector formed by a generally U-shaped member 191, and lower face 183 is formed with a hook 190. Member 191 consists of opposed parallel arms 192 and 193 integral with upper face 182, and which project outward from upper face 182 to outer ends 192A and 193A interconnected with an elongate cross-member 194. Arms 192 and 193 define opposed sides of member 191. Arms 192 cooperate with cross-member 191 and upper face 192 to form an opening 198.

A line 200 is depicted in conjunction with securing device 180 in FIGS. 23-25, and in FIG. 25 there is illustrated a flag 201 formed with a grommet 202. Flag 201 is depicted to clearly illustrate the attachment and interrelationship between grommet 202 formed in flag 201 and securing device 180. Securing device 180 is coupled between line 200 and grommet 202 of flag 201 to secure line 200 to flag 201.

To couple line 200 to securing device 180, a major loop 210 is formed in line 200 forming opposed standing parts 211 and 212 in the line 200. Referencing FIG. 23, major loop 210 is applied through opening 198, and major loop 210 is then folded over and across lower face 183 in the direction indicated by arcuate arrowed line I forming in major loop 210 opposite minor loops 214 and 215 at either end of the major loop 210 at arms 192 and 193 of member 191 as shown in FIG. 24, which are applied to or otherwise looped about arms 192 and 193 forming in major loop 210 a length 210' of line 200 extending between minor loops 214 and 215 along upper face 182 of slug 181. Standing parts 211 and 212 formed in line 200 are drawn outwardly to project outwardly and away from arms 192 and 193, respectively, in opposite directions and are pulled away from one another in the directions indicated by arrowed lines J and K, respectively, such that minor loops 214 and 215 are tightened about arms 192 and 193, respectively, as shown in FIGS. 24 and 25, and length 210' of line 200 is tightened between minor loops 214 and 215 applied to arms 192 and 193, respectively, of slug 181, and this secures the line 200 to slug 181. To attach flag 201 to securing device 180 coupled to line 200 as described and shown in FIGS. 24 and 25, grommet 202 of the flag 201 is simply applied to hook 190 as shown in FIG. 25 thereby securing flag 201 to securing device 180 forming a flag securing assembly constructed and arranged in accordance with the principle of the invention.

Figure 26:
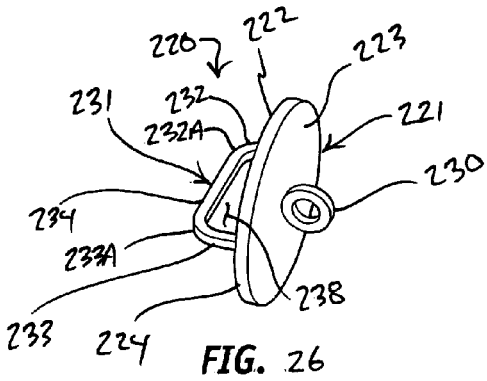
FIG. 26 is a perspective view of a yet still a further embodiment of securing device for securing a line to a flag grommet.
Figure 27:
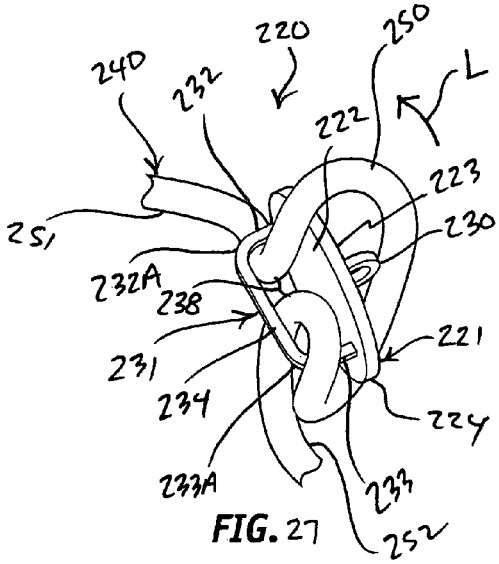
FIGS. 27-29 are perspective views of a sequence of steps of coupling the securing device of FIG. 24 to a line and to a flag grommet.
Figure 28:
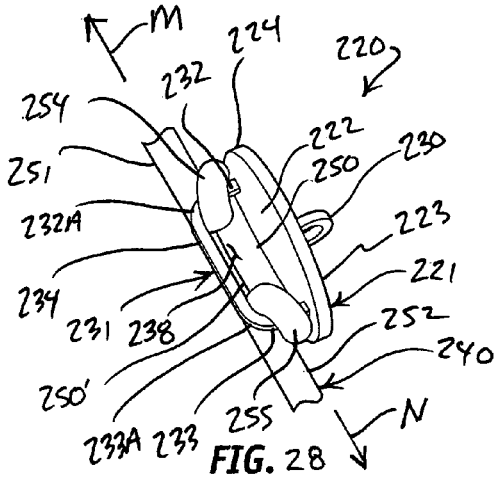
Figure 29:
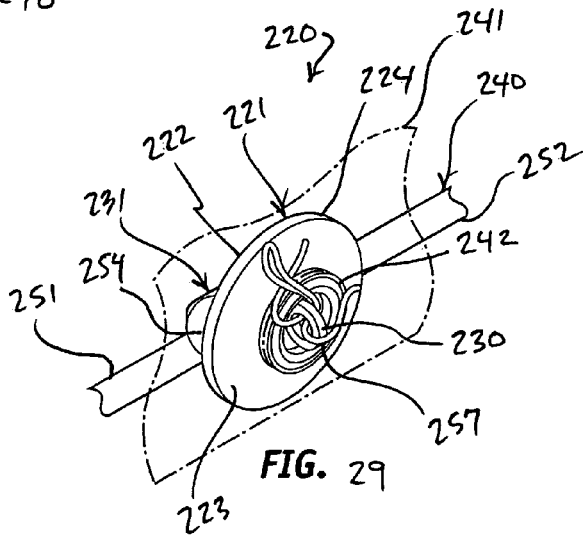

FIG. 26, which is a perspective view of a yet still a further embodiment of a securing device 180 for securing a cord or line to a flag grommet, and FIGS. 27-29, which are perspective views of a sequence of steps of coupling securing device 220 of FIG. 26 to a cord or line and to a flag grommet forming a flag securing assembly as shown in FIG. 29. Referencing FIG. 26, securing device 220 is fashioned of steel, aluminum, or the like, is preferably integrally formed, such as by stamping, machining, or molding, and consists of a generally flat and generally circular slug or member 221 having opposed upper and lower faces 222 and 223, and a perimeter edge 224. Upper face 222 is formed with an eyelet or eyelet connector formed by a generally U-shaped member 231, and lower face 223 is formed with an eyelet 230. Member 231 consists of opposed parallel arms 232 and 233 integral with upper face 222, and which project outward from upper face 222 to outer ends 232A and 233A interconnected with an elongate cross-member 234. Arms 232 and 233 define opposed sides of member 231. Arms 232 cooperate with cross-member 231 and upper face 232 to form an opening 238.

A line 240 is depicted in conjunction with securing device 220 in FIGS. 27-29, and in FIG. 29 there is illustrated a flag 241 formed with a grommet 242. Flag 241 is depicted in phantom outline for illustrative purposes to clearly illustrate the attachment and interrelationship between grommet 242 formed in flag 241 and securing device 220. Securing device 220 is coupled between line 240 and grommet 242 of flag 241 to secure line 240 to flag 241.

To couple line 240 to securing device 220, a major loop 250 is formed in line 240 forming opposed standing parts 251 and 252 in the line 240. Referencing FIG. 27, major loop 250 is applied through opening 238, and major loop 250 is then folded over and across lower face 223 in the direction indicated by arcuate arrowed line L forming in major loop 250 opposite minor loops 254 and 255 at either end of the major loop 250 at arms 232 and 233 of member 231 as shown in FIG. 28, which are applied to or otherwise looped about arms 232 and 233 forming in major loop 250 a length 250' of line 240 extending between minor loops 254 and 255 along upper face 222 of slug 221. Standing parts 251 and 252 formed in line 240 are drawn outwardly to project outwardly and away from arms 232 and 233, respectively, in opposite directions and are pulled away from one another in the directions indicated by arrowed lines M and N, respectively, such that minor loops 254 and 255 are tightened about arms 232 and 233, respectively, as shown in FIGS. 28 and 29, and length 250' of line 240 is tightened between minor loops 254 and 255 applied to arms 232 and 233, respectively, of slug 221, and this secures the line 240 to slug 221. To attach flag 241 to securing device 220 coupled to line 240 as described and shown in FIGS. 28 and 29, grommet 242 of the flag 241 is simply applied to and over eyelet 230 and against lower face 223, and a fastener 257 is applied through eyelet 230 thereby securing grommet 242 to eyelet 230 between fastener 257 and lower face 223 in turn securing flag 241 to securing device 220 forming a flag securing assembly constructed and arranged in accordance with the principle of the invention. In the present example, fastener 257 is a bendable, deformable wire. In alternate embodiment, fastener 257 can take on other forms, such as the form of a nut-and-bolt assembly, the form of a pin, etc.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

The invention claimed is:

1. A flag securing assembly, comprising:

a generally flat, elongate member having opposed upper and lower faces, first and second inwardly notched ends, opposed parallel first and second sides extending between the opposed first and second inwardly notched ends, and a length extending from the first inwardly notched end to the second inwardly notched end;

an opening formed through the elongate member from the upper face to the lower face between the opposed first and second inwardly notched ends and the opposed parallel first and second sides;

a lug affixed to the elongate member, the lug positioned proximate to the first inwardly notched end and projecting outward from the elongate member terminating with a free end;

a flag formed with a grommet;

a line;

a major loop formed in the line forming opposed first and second standing parts in the line;

the major loop applied through the opening formed in the elongate member from the lower face of the elongate member to the upper face of the elongate member;

the major loop folded over the elongate member from the upper face to the lower face forming in the major loop opposite first and second minor loops on either end of the major loop at the first and second inwardly notched ends of the elongate member;

the first and second minor loops applied to the first and second inwardly notched ends, respectively, of the elongate member forming in the major loop a length of the line extending between the first and second minor loops along the lower face of the elongate member;

the first and second standing parts formed in the line projecting outwardly and away from the opposed first and second inwardly notched ends in opposite directions and pulled away from one another such that the first and second minor loops are tightened within the first and second inwardly notched ends, respectively, and the length of the line is tightened between the first and second minor loops applied to the first and second inwardly notched ends of the elongate member;

the grommet of the flag applied to the lug between the free end of the lug and the elongate member;

a fastener applied to the free end of the lug captively retaining the grommet of the flag between the free end of the lug and the elongate member; and a strand-securing hole formed through the elongate member from the upper face to the lower face, the strand-securing hole is positioned proximate to the second inwardly notched end opposite to the lug formed proximate to the first inwardly notched end of the elongate member and is used to receive lashing to lash the elongate member to a support.

2. A flag securing assembly according to claim 1, further comprising:

a hole formed in the free end of the lug; and the fastener applied to the hole captively retaining the grommet of the flag between the free end of the lug and the elongate member.

3. A flag securing assembly according to claim 2, wherein the lug is integral with the elongate member.

4. A flag securing assembly according to claim 3, wherein the opening extends along substantially the entire length of the elongate member from the first inwardly notched end to the second inwardly notched end.

5. A flag securing assembly, comprising:

a generally flat, elongate member having opposed upper and lower faces, opposed first and second inwardly notched ends, opposed parallel first and second sides extending between the opposed first and second inwardly notched ends, and a length extending from the first inwardly notched end to the second inwardly notched end;

an opening formed through the elongate member from the upper face to the lower face between the opposed first and second inwardly notched ends and the opposed parallel first and second sides;

a lug affixed to the first side of the elongate member, the lug positioned proximate to the first inwardly notched end, and projecting laterally outward from the first side of the elongate member terminating with a free end;

a flag formed with a grommet;

a line;

a major loop formed in the line forming opposed first and second standing parts in the line;

the major loop applied through the opening formed in the elongate member from the lower face of the elongate member to the upper face of the elongate member;

the major loop folded over the elongate member from the upper face to the lower face forming in the major loop opposite first and second minor loops on either end of the major loop at the first and second inwardly notched ends of the elongate member;

the first and second minor loops applied to the first and second inwardly notched ends, respectively, of the elongate member forming in the major loop a length of the line extending between the first and second minor loops along the lower face of the elongate member;

the first and second standing parts formed in the line projecting outwardly and away from the opposed first and second inwardly notched ends in opposite directions and pulled away from one another such that the first and second minor loops are tightened within the first and second inwardly notched ends, respectively, and the length of the line is tightened between the first and second minor loops applied to the first and second inwardly notched ends of the elongate member;

the grommet of the flag applied to the lug between the free end of the lug and the first side of the elongate member;

a fastener applied to the free end of the lug captively retaining the grommet of the flag between the free end of the lug and the first side of the elongate member; and a strand-securing hole formed through the elongate member from the upper face to the lower face, the strand-securing hole is positioned proximate to the second inwardly notched end opposite to the lug formed proximate to the first inwardly notched end of the elongate member, is located along the second side of the elongate member opposite to the first side of the elongate member, and is used to receive lashing to lash the elongate member to a support along second side of elongate member opposite to the first side of the elongate member and the lug projecting laterally outward from the first side of the elongate member.

6. A flag securing assembly according to claim 5, further comprising:

a hole formed in the free end of the lug; and the fastener applied to the hole captively retaining the grommet of the flag between the free end of the lug and the first side of the elongate member.

7. A flag securing assembly according to claim 6, wherein the lug is integral with the first side of the elongate member.

8. A flag securing assembly according to claim 7, wherein the opening extends along substantially the entire length of the elongate member from the first inwardly notched end to the second inwardly notched end.

9. A flag securing assembly, comprising:

a generally flat, elongate member having opposed upper and lower faces, opposed first and second inwardly notched ends, opposed parallel first and second sides extending between the opposed first and second inwardly notched ends, and a length extending from the first inwardly notched end to the second inwardly notched end;

first and second openings formed through the elongate member from the upper face to the lower face between the opposed first and second inwardly notched ends and the opposed parallel first and second sides;

a lug affixed to the elongate member, the lug positioned proximate to the first inwardly notched end and projecting outward from the elongate member terminating with a free end;

a flag formed with a grommet;

a line;

the line threaded through the first and second openings forming in the line a major loop along the upper face of the elongate member and opposed first and second standing parts along the lower surface of the elongate member at the opposed first and second notched ends of the elongate member;

the major loop folded over the elongate member from the upper face to the lower face forming in the major loop opposite first and second minor loops on either end of the major loop at the first and second inwardly notched ends of the elongate member;

the first and second minor loops applied to the first and second inwardly notched ends, respectively, of the elongate member forming in the major loop a length of the line extending between the first and second minor loops along the lower face of the elongate member;

the first and second standing parts formed in the line projecting outwardly and away from the opposed first and second inwardly notched ends in opposite directions and pulled away from one another such that the first and second minor loops are tightened within the first and second inwardly notched ends, respectively, and the length of the line is tightened between the first and second minor loops applied to the first and second inwardly notched ends of the elongate member;

the grommet of the flag applied to the lug between the free end of the lug and the elongate member;

a fastener applied to the free end of the lug captively retaining the grommet of the flag between the free end of the lug and the elongate member; and a strand-securing hole formed through the elongate member from the upper face to the lower face, the strand-securing hole is positioned proximate to the second inwardly notched end opposite to the lug formed proximate to the first inwardly notched end of the elongate member and is used to receive lashing to lash the elongate member to a support.

10. A flag securing assembly according to claim 9, further comprising:

a hole formed in the free end of the lug; and the fastener applied to the hole captively retaining the grommet of the flag between the free end of the lug and the elongate member.

11. A flag securing assembly according to claim 10, wherein the lug is integral with the elongate member.

12. A flag securing assembly according to claim 11, wherein one of the first and second openings extends along substantially the entire length of the elongate member from the first inwardly notched end to the second inwardly notched end.

13. A flag securing assembly, comprising:

a generally flat, elongate member having opposed upper and lower faces, opposed first and second inwardly notched ends, opposed parallel first and second sides extending between the opposed first and second inwardly notched ends, and a length extending from the first inwardly notched end to the second inwardly notched end;

opposed first and second openings formed through the elongate member from the upper face to the lower face between the opposed first and second inwardly notched ends and the opposed parallel first and second sides;

a lug affixed to the elongate member, the lug positioned proximate to the first inwardly notched end, positioned between the opposed first and second openings formed through the elongate member, and projecting outward from the upper face of the elongate member terminating with a free end;

a flag formed with a grommet;

a line;

the line threaded through the first and second openings forming in the line a major loop along the upper face of the elongate member and opposed first and second standing parts along the lower surface of the elongate member at the opposed first and second notched ends of the elongate member;

the major loop folded over the elongate member from the upper face to the lower face forming in the major loop opposite first and second minor loops on either end of the major loop at the first and second inwardly notched ends of the elongate member;

the first and second minor loops applied to the first and second inwardly notched ends, respectively, of the elongate member forming in the major loop a length of the line extending between the first and second minor loops along the lower face of the elongate member;

the first and second standing parts formed in the line projecting outwardly and away from the opposed first and second inwardly notched ends in opposite directions and pulled away from one another such that the first and second minor loops are tightened within the first and second inwardly notched ends, respectively, and the length of the line is tightened between the first and second minor loops applied to the first and second inwardly notched ends of the elongate member;

the grommet of the flag applied to the lug between the free end of the lug and the upper face of the elongate member;

a fastener applied to the free end of the lug captively retaining the grommet of the flag between the free end of the lug and the upper face of the elongate member; and a strand-securing hole formed through the elongate member from the upper face to the lower face, the strand-securing hole is positioned proximate to the second inwardly notched end opposite to the lug formed proximate to the first inwardly notched end of the elongate member and is used to receive lashing to lash the elongate member to a support.

14. A flag securing assembly according to claim 13, further comprising:

a hole formed in the free end of the lug; and the fastener applied to the hole captively retaining the grommet of the flag between the free end of the lug and the upper face of the elongate member.

15. A flag securing assembly according to claim 14, wherein the lug is integral with the elongate member.

16. A flag securing assembly according to claim 15, wherein one of the first and second openings extends along substantially the entire length of the elongate member from the first inwardly notched end to the second inwardly notched end.

* * * * *